US007373679B2

(12) United States Patent
Miller

(10) Patent No.: US 7,373,679 B2
(45) Date of Patent: May 20, 2008

(54) ADJUSTABLE MOBILITY ASSISTANCE DEVICE

(75) Inventor: F. Troy Miller, Logan, UT (US)

(73) Assignee: Standers, Inc., Logan, UT (US)

( * ) Notice: Subject to any disclaimer, the term of this patent is extended or adjusted under 35 U.S.C. 154(b) by 264 days.

(21) Appl. No.: 11/252,675

(22) Filed: Oct. 18, 2005

(65) Prior Publication Data

US 2007/0083994 A1 Apr. 19, 2007

(51) Int. Cl.
*A47C 21/08* (2006.01)

(52) U.S. Cl. ..... 5/662; 5/426; 5/430

(58) Field of Classification Search ..... 5/662, 5/25–430

See application file for complete search history.

(56) References Cited

U.S. PATENT DOCUMENTS 3,220,024 A * 11/1965 Nelson ..... 5/429
3,262,133 A * 7/1966 Beitzel ..... 5/610
4,724,559 A 2/1988 Bly et al. ..... 5/425
5,448,791 A 9/1995 Brown ..... 5/662
5,640,726 A * 6/1997 Fichner-Rathus ..... 5/426
6,138,301 A 10/2000 Battiston ..... 5/81.1 R
6,401,280 B1 * 6/2002 Baker ..... 5/662
6,519,794 B1 2/2003 Aarestad et al. ..... 5/430
6,560,794 B2 * 5/2003 Allen et al. ..... 5/81.1 R
7,103,928 B1 * 9/2006 Childs ..... 5/426
7,197,779 B2 * 4/2007 Shalikar ..... 5/426

OTHER PUBLICATIONS

SenoirShops, Carex Adjustable Bed Rails, http://www.senoirshops.com/bedrails1.html, printed Oct. 11, 2005, 2 pgs.
Home-style Bed Rails, http://www.jamesonmedical.com/pages/bed_rails.htm, printed Oct. 11, 2005, 1 pg.

* cited by examiner

*Primary Examiner*—Michael Trettel
(74) *Attorney, Agent, or Firm*—Stoel Rives LLP

(57) ABSTRACT

An adjustable mobility assistance device providing support for a user on a bed or similar furniture is disclosed. The mobility assistance device may include a base that can fit under a mattress and a support rail that extends upright relative to the base. The longitudinal dimension of the support rail may be adjustable independent of the base. The support rail may be pivotally coupled to the base so that it can be disposed in an upright configuration or a lowered configuration while the base is under a mattress.

14 Claims, 5 Drawing Sheets

100

ADJUSTABLE MOBILITY ASSISTANCE DEVICE

TECHNICAL FIELD

The present disclosure relates generally to mobility assistance devices. More specifically, the present disclosure relates to assistance devices, such as bed rail devices, that can assist individuals in positioning themselves onto and securing themselves in beds or similar furniture.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the invention, as claimed, but is merely representative of various embodiments. While the various aspects of the embodiments are presented in drawings, the drawings are not necessarily drawn to scale unless specifically indicated.

The phrases "connected to," "coupled to" and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Figure 1:
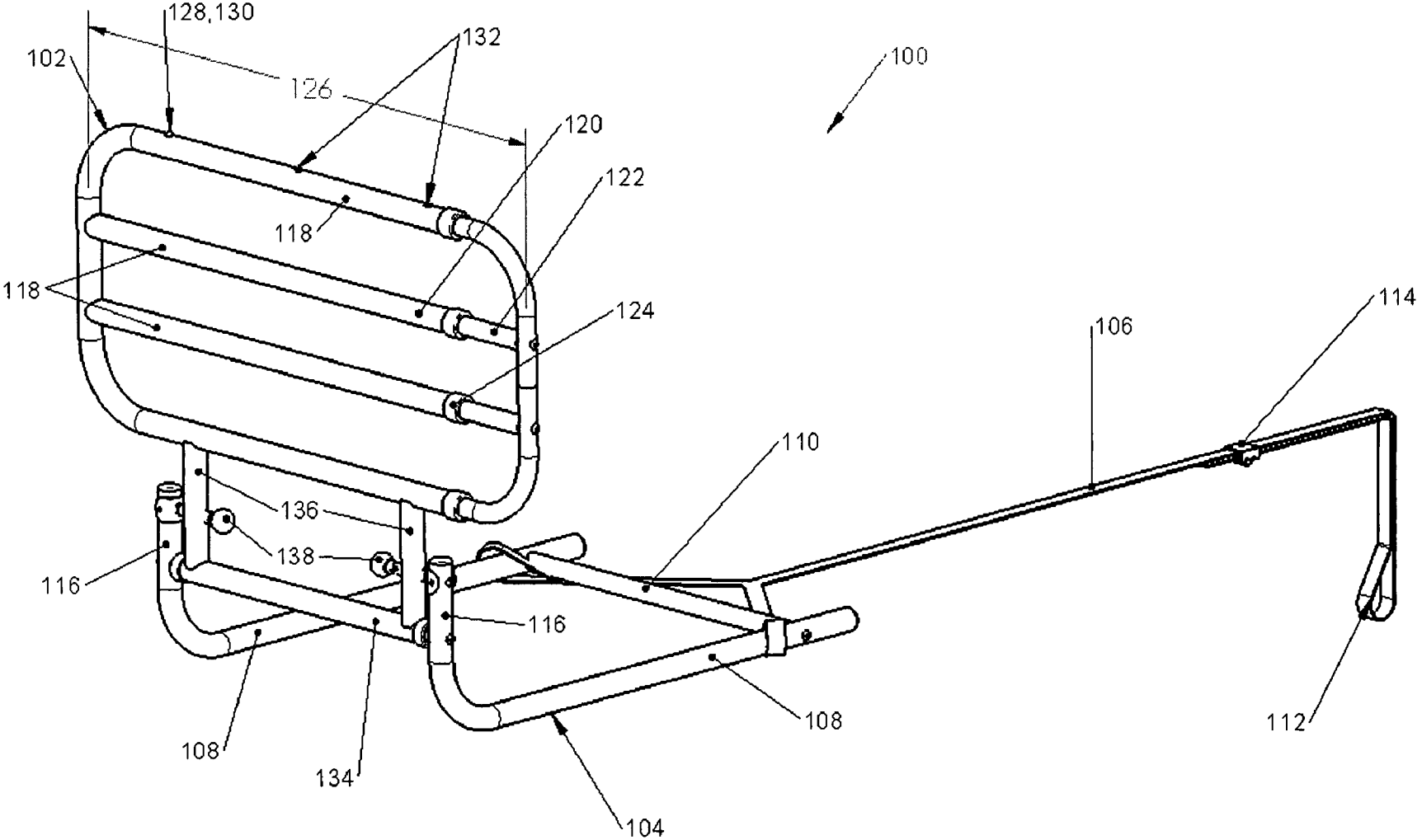
FIG. 1 is a perspective view of one embodiment of a mobility assistance device.

FIG. 1 represents one embodiment of a mobility assistance device 100 as shown from a perspective view. Mobility assistance devices are typically used to assist individuals with disabilities and/or other infirmities that may be incident to accidents, disease, age or similar causes. Mobility assistance devices are designed to help these individuals get into and out of reclining, sitting and/or prone positions on a bed or similar piece of furniture or object designed for one to sit, lie down or sleep on. Furthermore, bed rails also serve the function of securing an individual in a bed so that they do not fall out accidentally. The mobility assistance device 100 depicted may be used with a bed as a bed rail device.

The assistance device 100 may include a support rail portion 102, a base portion 104, and a securement strap 106. In one embodiment, the base portion 104 of the assistance device 100 is designed to fit between a mattress and box spring of a bed, or underneath the cushion of a couch, or similar furniture. The base portion 104 provides support for the support rail portion 102 when a user pulls or pushes thereon.

According to the embodiment depicted, the base portion 104 may include legs 108 that are optionally parallel to each other and optionally interconnected by a crossbar 110. However, in alternative embodiments, the base portion 104 may include a planar member having dimensions to fit between a mattress and box spring of a bed. Those having skill in the art with the aid of the present disclosure will recognize that various configurations and designs of the base portion may be used to provide the necessary support for the rail portion 102, including, but not limited to, a base portion 104 designed to extend down to the floor, or underneath both the mattress and box spring, or coupled to a bed frame.

The securement strap 106 may be a strap of nylon, fabric, or similar construction that is coupled to the base portion 104, for example, at the end furthest away from the support rail portion 104, such as adjacent the crossbar 110. The securement strap 106 may be used as an anchoring mechanism to prevent the base portion 104 from slipping out from between the mattress and the box spring of the bed. The securement strap 106 may be designed to extend between the mattress and box spring and be secured to the bed frame or similar structure at an anchoring member 112. Alternatively, the securement strap 106 may be anchored to the mattress and/or box spring. The strap 106 may also include an adjustment buckle 114 to adjust the length of the strap 106 so that it may fit various sizes and types of beds. The strap 106 may then be tightened through the adjustment buckle 114 in a manner that prevents the base portion 104 from slipping out from between the mattress and box spring.

According to the embodiment depicted in FIG. 1, the base portion 104 may also include elbows 116 that extend from the base legs 108 and turn upward toward the support rail portion 102. The elbows 116 may be integrally formed with the base legs 108, or alternatively, may be a separate piece coupled to the legs 108 and extending substantially orthogonal to the legs 108. The rail portion 102 of the embodiment depicted is coupled to the elbows 116 of the base portion 104, causing the support rail portion 102 to extend above the side of the base portion 104 at approximately 90°. As would be appreciated by one having skill in the art with the aid of the present disclosure, alternative components may be used to couple the base portion 104 to the rail portion 102, including by way of example, brackets, sleeves, etc. Furthermore, the support rail portion 102 may deviate somewhat from a 90° angle in alternative embodiments.

The support rail portion 102 of the mobility assistance device 100 includes multiple rail support bars 118 for providing support for an individual during ingress and egress to and from the bed or similar furniture. For example, once the base portion 104 is positioned in the bed as described herein, the user may grip the rail support bars 118 at any point and lower himself onto the bed. The user may also maintain contact with the rail support bars 118 in order to position himself on the bed. Likewise, if the user desires to get out of the bed, the user may grip the rail support bars 118 to swing his legs off the bed. Once in this position, the user may pull on the support bars 118 in order to rise into a standing position. While moving to a standing position, the support bars 118 assist the user in establishing his balance.

As would be apparent to those having skill in the art, the distance between rail support bars 118 may be selected such that a portion of an individual's body, such as a user's head, would be unable to fit between two adjacent rail support bars 118. Consequently, the support rail portion 102 also may function to prevent users from falling out of bed.

The rail support bars 118 may comprise a first rail member 120 slidably coupled to a second rail member 122. In alternative embodiments, more than two rail members may be used. In the embodiment depicted, the first rail member 120 comprises four rail support bars 118, each having a coupling opening 124 to receive the second rail member 120 which also comprises four rail support bars 118. By way of example, the rail support bars 118 of the first rail member 120 are sleeves that have a slightly larger diameter than the rail support bars 118 of the second rail member 122. The sleeves of the second rail member 122 may slide within those of the first rail member 120 so that the sleeves are coaxially oriented. Telescopic movement of the first and second rail members 120, 122 can cause the longitudinal dimension 126 to expand or contract as desired.

The support rail portion 102 may further include a securing mechanism, such as a detent mechanism 128 comprising a protrusion 130 disposed on the second rail member 122 that engages one of a plurality of orifices 132 disposed on the first rail member 120. In order to alter the longitudinal dimension 126 of the support rail portion 102, a user may depress the protrusion 130, such that it is deflected out of its position in one of the orifices 132. The two rail members 120, 122 may then be slid apart from one another until the protrusion 130 engages a different orifice 132, which secures the two rail members 120, 122 in a position relative to each other that coincides with the desired longitudinal dimension 126 of the support rail portion 102. A similar action may be used to shorten the longitudinal dimension 126 of the support rail portion 102 by sliding the two rail members 120, 122 toward one another.

Alternative embodiments may include a different securing mechanism such as a locking nut mechanism, where a locking nut is disposed adjacent at least one coupling opening and can be twisted to secure the two rail members 120, 122 at a particular position relative to each other. In such an embodiment, the longitudinal dimension 126 of the support rail member 102 may be altered along any desirable length instead of a particular length as depicted in the embodiment illustrated in FIG. 1. In embodiments having more than two rail members, more than one locking nut may be used to secure the relative positions of each rail member to maintain a desirable longitudinal dimension of the support rail portion. As would be apparent to those having skill in the art with the aid of the present disclosure, alternative securing mechanisms may be used to secure the relative positions of the first and second rail members 120, 122.

Figure 4:
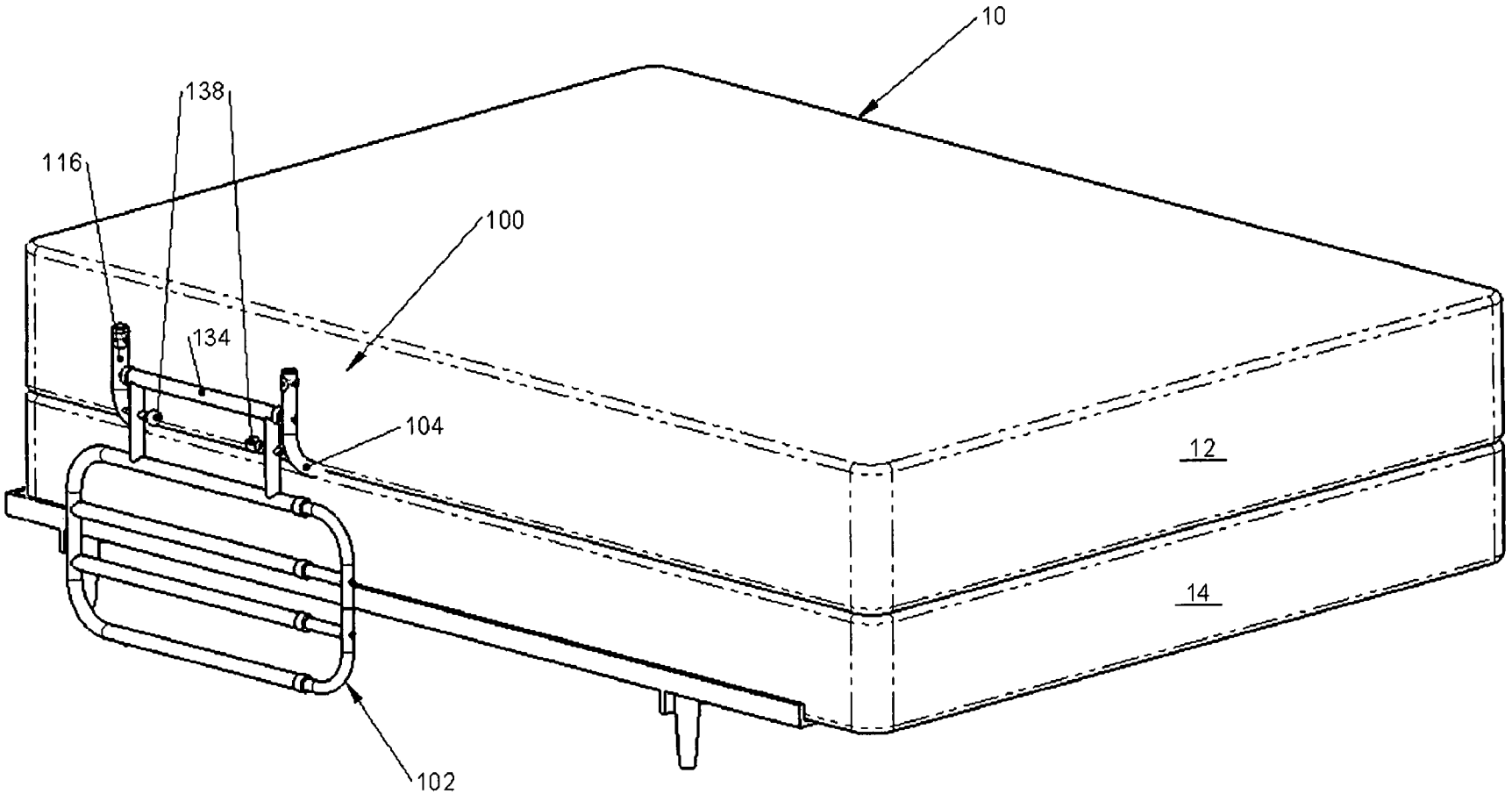
FIG. 4 is a perspective view of the mobility assistance device of FIG. 1 with the rail portion in a lowered position.

Referring still to FIG. 1, the support rail portion 102 may be pivotally coupled to the base portion 104 through an axle. In the embodiment depicted, the axle may comprise a transverse shaft 134 that is positioned between the two elbows 116 of the base portion 104. Alternatively, the axle may be disposed within the transverse shaft. The transverse shaft 134 may be fixedly connected to the rail support bars 118 through orthogonal supports 136. The transverse shaft 134 may also be rotatably coupled to the two elbows 116, such that rotation of the shaft 134 causes the rail support bars 118 to pivot. Consequently, the support rail portion 102 may pivot from an upright position as depicted in FIG. 1 to a lowered position as depicted in FIG. 4.

The orthogonal supports 136 may further be maintained adjacent the elbows 116 of the base portion 104 through a securing member such as engagement pins 138. Engagement pins 138 may be movably coupled to the orthogonal supports 136, and in turn engage with corresponding retaining holes on the elbows 116. When at least one pin 138 is engaged with an elbow 116, the support rail portion 102 is secured in an upright configuration. When both pins 138 are disengaged from the elbows 116, the support rail portion 102 may pivot to a lowered position as will be described in greater detail hereinafter. In alternative embodiments, a single engagement pin 138 or more than two pins 138 may be used. The functionality of the pins will be described in greater detail in conjunction with FIG. 5.

Figure 2:
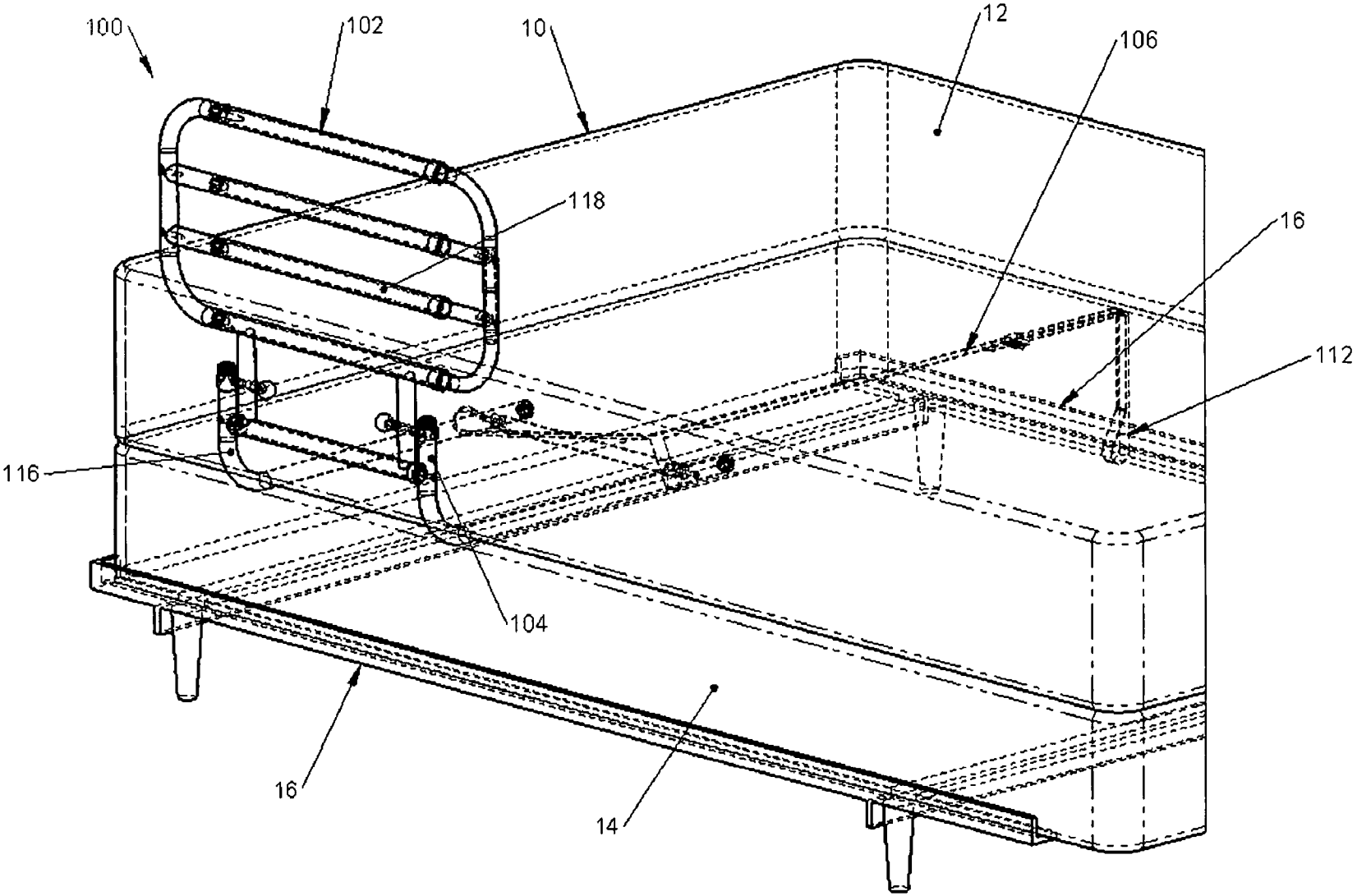
FIG. 2 is a perspective view of the mobility assistance device of FIG. 1, as used adjacent a bed.

FIG. 2 illustrates the mobility assistance device 100 of FIG. 1, as shown in a functional position adjacent a bed 10. As described earlier, the base portion 104 of the assistance device 100 has dimensions that are configured to fit between a mattress 12 and a box spring 14. The part of the base portion 104 that is disposed between the mattress 12 and the box spring 14 is illustrated in phantom. The elbows 116 of the base portion 104 extend from below the mattress 12, upwards to adjacent the side of the mattress 12 and are coupled to the support rail portion 102. The support rail portion 102 includes rail support bars 118 that extend above the mattress 12 to provide support for a user on the bed 10 or for a user's ingress and egress to and from the bed 10.

The base portion 104 may be maintained in its position between the mattress 12 and box spring 14 through the securement strap 106. As described herein, the securement strap 106 may be used as an anchoring mechanism to prevent the base portion 104 from slipping out from between the mattress 12 and the box spring 14 of the bed 10. The securement strap 106 extends to the side of the bed 10 opposite the assistance device 100 and may be secured to a bed frame 16 or similar structure at an anchoring member 112.

Figure 3B:
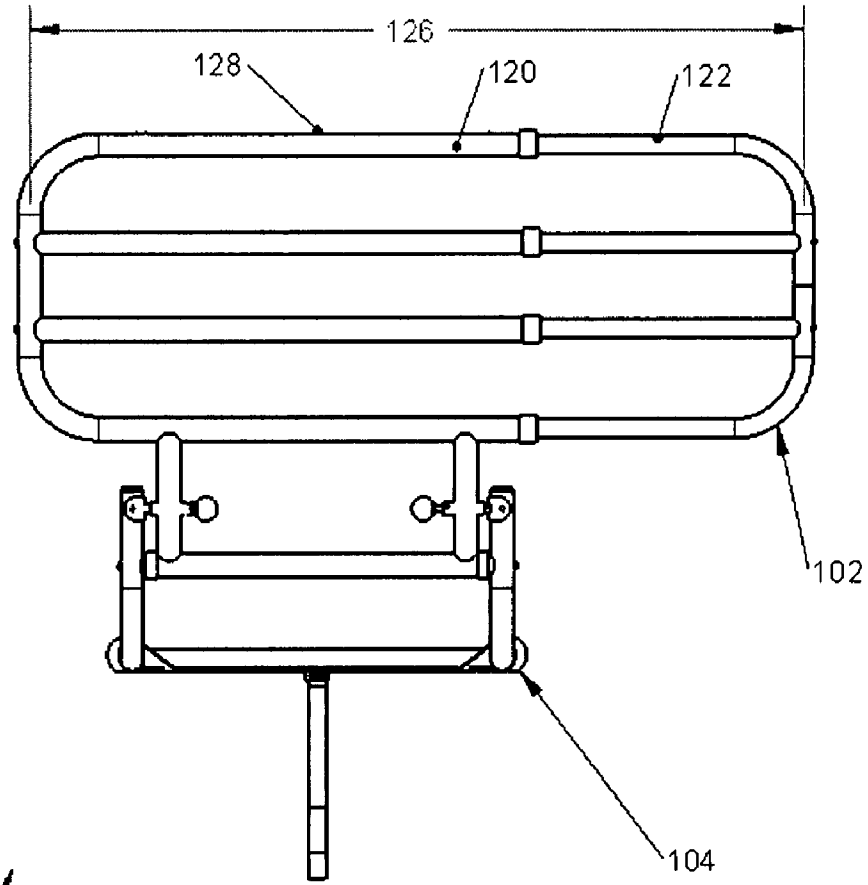
FIG. 3B is a side elevation view of the mobility assistance device of FIG. 3A with its rail portion extended.
Figure 3A:
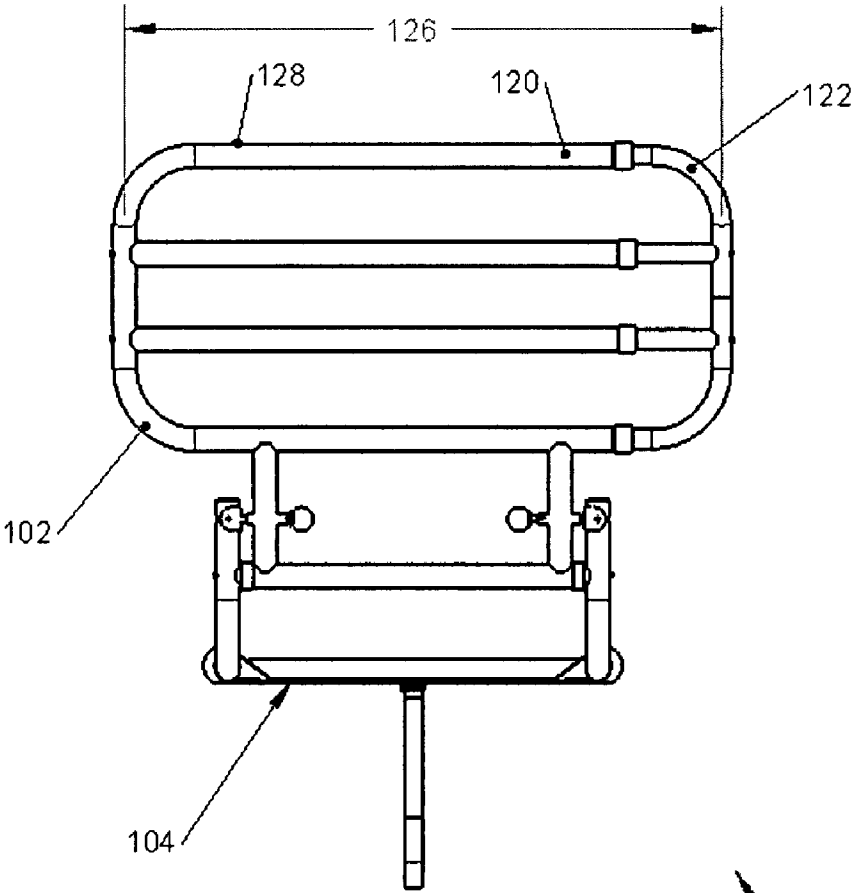
FIG. 3A is a side elevation view of a the mobility assistance device of FIG. 1.

FIG. 3A represents the mobility assistance device 100 of FIG. 1 as shown from a side elevation view. FIG. 3B represents the mobility assistance device 100 of FIG. 3A as shown from a side elevation view having the longitudinal dimension 126 of the support rail portion 102 extended. As described above, the support rail portion 102 may include first and second rail members 120, 122 that are coaxially aligned such that the first rail member 120 circumscribes a portion of the second rail member 122.

If a user desires to increase the longitudinal dimension 126 of the rail portion 102, the second rail member 122 is pulled away from the first rail member 120 in a telescopic fashion. According to the embodiment depicted, when the longitudinal dimension 126 is increased, such as in FIG. 3B, a smaller length of the second rail member 122 is circumscribed by the first rail member 120 compared to a shortened longitudinal dimension 126 as shown in FIG. 3A.

If a user desires to decrease the longitudinal dimension 126 of the rail portion 102, the second rail member 122 is pushed toward the first rail member 120 in a telescopic fashion. The expansion or contraction of the longitudinal dimension 126 of the support rail portion 102 may occur while the base portion 104 is disposed between the mattress and box spring as shown in FIG. 2 since the longitudinal dimension 126 of the rail portion 102 may be adjusted independent of the base portion 104.

According to the embodiment depicted in FIGS. 3A and 3B, the support rail portion 102 further includes a detent mechanism 128 to secure the rail portion 102 at a particular longitudinal dimension 126. As heretofore described, the detent mechanism 128 comprises a protrusion and a series of corresponding orifices to secure the slidably-engaging rail members 120, 122 at particular positions with respect to each other to maintain particular longitudinal dimensions of the rail portion 102. Alternative securing mechanisms may also be used as described above.

FIG. 4 represents the mobility assistance device 100 of FIG. 1 from a perspective view, with the support rail portion 102 in a lowered position. The assistance device 100 is illustrated in its operational configuration where the base portion 104 is disposed between the mattress 12 and the box spring 14 of the bed 10. In the lowered position, the support rail portion 102 no longer obstructs the portion of the bedside that is typically restricted by the support rail portion 102 in its upright position (see FIG. 2).

When a user desires to lower the support rail portion 102 of the assistance device 100, the user may disengage the pins 138 from engagement with the elbows 116 of the base portion 104. The support rail portion 102 may then pivot about the transverse shaft 134, so that the rail portion 102 swings away from the bed 10 while moving to the lowered position. This may all be accomplished while the base portion 104 is disposed between the mattress 12 and box spring 14.

The support rail portion 102 in the lowered position extends in a direction that is substantially opposite from the support rail portion 102 in the upright position. In other words, the rail portion 102 moves from the upright position (FIG. 2) that is adjacent and above the base portion 104 at an approximate 90° angle, to a position that is adjacent and below the base portion 104 at an approximate 90° angle. Therefore, the support rail portion 102 may move approximately 180° from the upright configuration to the lowered configuration.

Once in the lowered configuration, the support rail portion 102 may be pivoted about the transverse shaft 134 to the upright configuration as desirable. The support rail portion 102 may pivot at all possible longitudinal dimensions of the rail portion 102, i.e., in an extended or contracted configuration. Alternative methods of pivoting may also be used in light of the present disclosure. For example, the rail portion 102 in alternative embodiments could pivot to the lowered position within the plane created by the rail portion 102 in the upright position.

Figure 5:
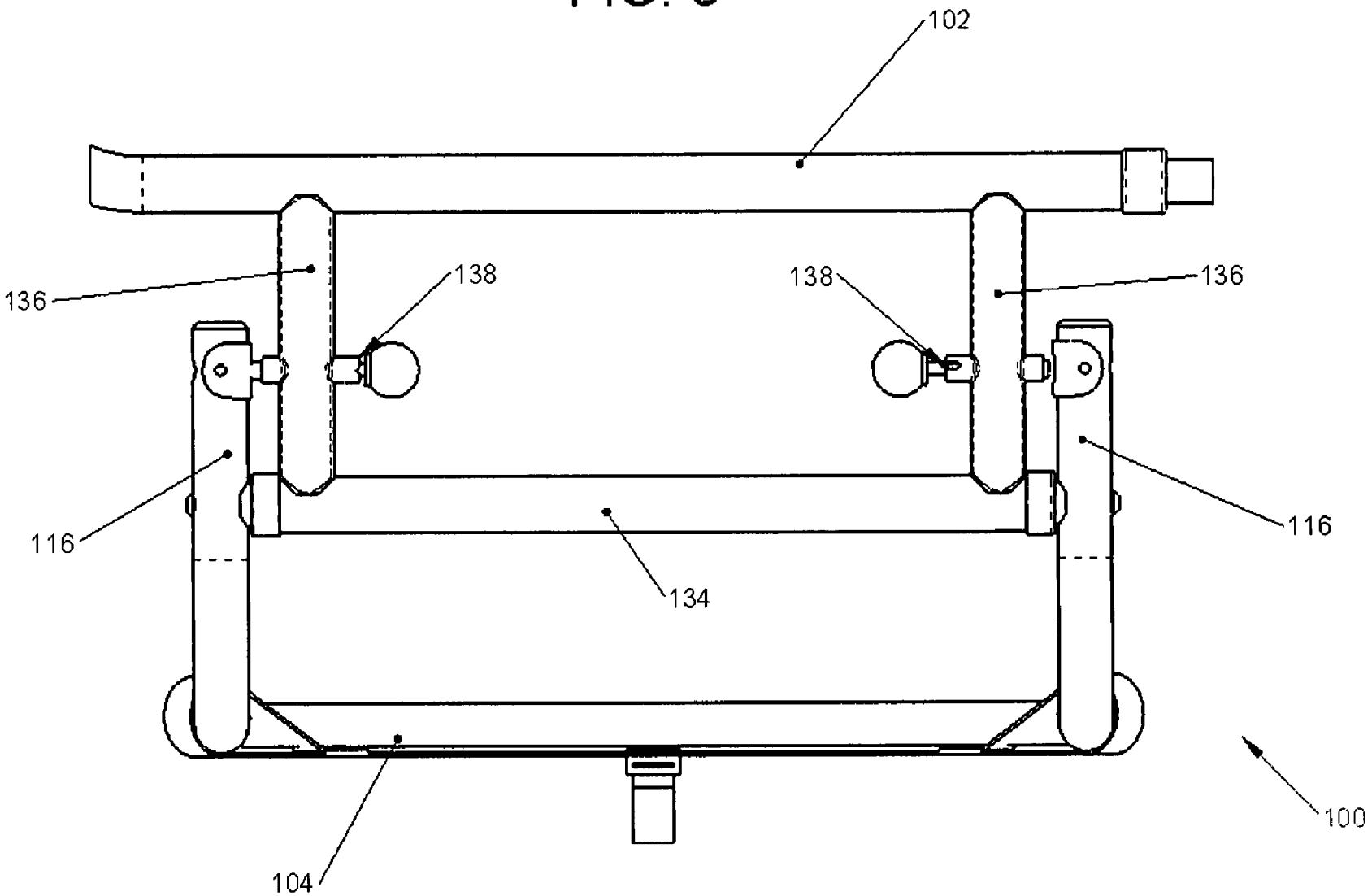
FIG. 5 is a partially cut-away side elevation view of the mobility assistance device of FIG. 1, illustrating securing mechanisms used to secure the rail portion in an upright position.

FIG. 5 represents the mobility assistance device 100 of FIG. 1 as shown from a partially cut-away side elevation view, illustrating the securing mechanisms 138 used to secure the side rail portion 102 in an upright configuration. As discussed herein, the securing mechanisms 138 may comprise moveable engagement pins 138 that may be coupled with the elbows 116 of the base portion 104 and the orthogonal supports 136 of the support rail portion 102.

The engagement pins 138 may be coupled to the orthogonal supports 136 in a manner that allows the pins 138 to move perpendicular to the orthogonal supports 136 while not becoming uncoupled from the orthogonal supports 136. Consequently, the engagement pins 138 may engage the elbows 116 as illustrated with the left engagement pin 138 of FIG. 5, or the pins 138 may become disengaged from the elbows 116 as demonstrated with the right engagement pin 138 of FIG. 5. An engaged pin 138 intersects both the elbow 116 and the orthogonal support 138 while a disengaged pin 138 intersects the orthogonal support 136 and not the elbow 116. In alternative embodiments, the disengaged pin 138 may intersect the elbow 116 and not the orthogonal support 136.

When either pin 138 is engaged with its respective elbow 116, the support rail portion 102 is maintained in the upright configuration. However, when both pins 138 are disengaged from the elbows 116, the support rail portion 102 may pivot about the transverse shaft 134 to the lowered configuration as illustrated in FIG. 4.

In the embodiment depicted in FIG. 5, the engagement pins 138 are both located within arms length of each other so an individual can disengage both pins 138 simultaneously, if desired. Furthermore, like the embodiment shown in FIG. 5, having one pin 138 engaged and another disengaged 138 allows an individual, while on a bed, to disengage the remaining pin 138 and pivot the support rail portion 102 to its lowered configuration.

Alternative securement mechanisms would be apparent to those having skill in the art with the aid of the present disclosure. For example, threaded screws having a hand knob at one end may be used to interconnect the orthogonal supports 136 and the corresponding base elbows 116. Alternatively, a detent mechanism may also be used to secure the support rail portion 102 in an upright configuration.

While specific embodiments of mobility assistance devices have been illustrated and described, it is to be understood that the invention claimed hereinafter is not limited to the precise configuration and components disclosed. Various modifications, changes, and variations apparent to those of skill in the art may be made in the arrangement, operation, and details of the methods and systems disclosed.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the invention as claimed hereinafter. In other words, various modifications and improvements of the embodiments specifically disclosed in the description above are within the scope of the appended claims. Note that elements recited in means-plus-function format are intended to be construed in accordance with 35 U.S.C. § 112 ¶6.

What is claimed is:

1. A mobility assistance device to provide support for a user on a bed or similar furniture, comprising:

a base portion having dimensions configured to be disposed between a mattress and box spring of the bed;

a support rail portion coupled to and extending upright relative to the base portion, the support rail portion having a longitudinal dimension that is adjustable independent of the base portion; and a transverse shaft coupled to the support rail portion and extending a width of the base portion, the transverse shaft rotatably coupled to the base portion;

wherein the longitudinal dimension of the support rail can be lengthened or shortened while the base portion is disposed under the mattress, and the support rail portion is pivotally coupled to the base portion through the transverse shaft, such that the support rail portion may pivot from an upright position to a lowered position by rotating about the transverse shaft.

2. The assistance device of claim 1, wherein the support rail portion comprises at least two rail members that are slidably engaged with each other.

3. The assistance device of claim 2, wherein the at least two rail members each comprise a sleeve that is coaxially oriented with the sleeve of another rail member, such that the support rail portion can expand telescopically.

4. The assistance device of claim 2, further comprising:

a securing mechanism to secure the at least two rail members at a position relative to each other to maintain a particular longitudinal dimension.

5. The assistance device of claim 1, wherein the support rail portion in the upright position extends adjacently above and approximately orthogonal to the base portion, and the support rail portion in the lowered position extends adjacently below and approximately orthogonal to the base portion.

6. The assistance device of claim 1, wherein the support rail portion can pivot from the upright position to the lowered position while the base portion is disposed under the mattress.

7. A mobility assistance device to provide support for a user on a bed or similar furniture, comprising:

a base portion having dimensions configured to be disposed between a mattress and box spring of the bed;

a rail portion pivotally coupled to the base portion, such that the rail portion may pivot from an upright configuration to a lowered configuration while the base portion is disposed under the mattress; and a first securing member comprising a disengageable pin that is engaged with both the base portion and the rail portion to secure the rail portion in the upright configuration, the first securing member being disengaged from either the base portion or the rail portion to pivot the rail portion to the lowered configuration;

wherein the rail portion in the lowered configuration extends in a substantially opposite direction from the upright configuration.

8. The assistance device of claim 7, wherein the pin is engaged with either the base portion or the rail portion, but not both, when the securing member is disengaged.

9. The assistance device of claim 7, further comprising:

a second securing member to secure the rail portion in the upright configuration, wherein the first and second securing members are capable of being disengaged simultaneously by a single user.

10. The assistance device of claim 7, wherein the rail portion is configured to pivot away from the bed when moving from the upright configuration to the lowered configuration.

11. The assistance device of claim 7, wherein the rail portion has a longitudinal dimension that is adjustable independent of the base portion.

12. The assistance device of claim 11, wherein the longitudinal dimension of the rail portion can be lengthened or shortened while the base portion is disposed under the mattress.

13. An adjustable bed rail device, comprising:

a base portion configured to be disposed between a mattress and box spring of a bed;

a bed rail portion coupled to the base portion;

means for adjusting a length of the bed rail portion independent of the base portion;

means for pivoting the bed rail portion from an upright position to a lowered position while the base portion is disposed under the mattress; and means for securing the bed rail portion in the upright position, wherein the securing means comprises a pin that is engaged with both the base portion and the bed rail portion to secure the bed rail portion in the upright position, the pin disengaged from either the base portion or the bed rail portion to pivot the bed rail portion to the lowered position.

14. The bed rail device of claim 13, further comprising:

means for maintaining the bed rail portion at a particular length.

* * * * *

UNITED STATES PATENT AND TRADEMARK OFFICE

CERTIFICATE OF CORRECTION

PATENT NO. : 7,373,679 B2
APPLICATION NO. : 11/252675
DATED : May 20, 2008
INVENTOR(S) : F. Troy Miller It is certified that error appears in the above-identified patent and that said Letters Patent is hereby corrected as shown below:

Column 3, Line 45 reads, "...support rail member 102 may be altered..." which should read, "...support rail portion 102 may be altered..."

Column 3, Line 60 reads, "...within the transverse shaft." which should read, "...within the transverse shaft 134."

Column 5, Line 63 reads, "...the orthogonal support 138..." which should read, "...the orthogonal support 135..."

Signed and Sealed this

Fifteenth Day of September, 2009

David J. Kappos

David J. Kappos
*Director of the United States Patent and Trademark Office*